US011078608B2

(12) United States Patent
Tanaka et al.

(10) Patent No.: US 11,078,608 B2
(45) Date of Patent: Aug. 3, 2021

(54) FABRIC, METHOD FOR MANUFACTURING SAME, AND FIBER PRODUCT

(71) Applicant: TEIJIN LIMITED, Osaka (JP)

(72) Inventors: Kengo Tanaka, Osaka (JP); Hiroki Shimada, Osaka (JP); Kenji Iwashita, Osaka (JP); Kenji Yoshihara, Osaka (JP)

(73) Assignee: TEIJIN LIMITED, Osaka (JP)

( * ) Notice: Subject to any disclaimer, the term of this patent is extended or adjusted under 35 U.S.C. 154(b) by 0 days.

(21) Appl. No.: 16/346,290

(22) PCT Filed: Oct. 25, 2017

(86) PCT No.: PCT/JP2017/038453
§ 371 (c)(1),
(2) Date: Apr. 30, 2019

(87) PCT Pub. No.: WO2018/084040
PCT Pub. Date: May 11, 2018

(65) Prior Publication Data

US 2020/0063299 A1 Feb. 27, 2020

(30) Foreign Application Priority Data

Nov. 1, 2016 (JP) ..... JP2016-214220
Feb. 22, 2017 (JP) ..... JP2017-031094

(51) Int. Cl.

| | |
|---|---|
| ***D02G 3/04*** | (2006.01) |
| ***D02G 3/44*** | (2006.01) |
| ***D03D 15/47*** | (2021.01) |
| ***D03D 15/513*** | (2021.01) |
| ***D03D 15/533*** | (2021.01) |
| ***D03D 15/54*** | (2021.01) |
| ***D03D 1/00*** | (2006.01) |
| ***A41D 13/008*** | (2006.01) |
| *A41D 31/08* | (2019.01) |
| *D01F 8/10* | (2006.01) |
| *D01F 1/09* | (2006.01) |
| *A41D 31/26* | (2019.01) |
| *D03D 15/292* | (2021.01) |
| *D01F 6/60* | (2006.01) |
| *D01F 6/52* | (2006.01) |
| *D03D 15/41* | (2021.01) |
| *D01F 1/06* | (2006.01) |
| *D03D 15/00* | (2021.01) |
| *A41D 31/00* | (2019.01) |
| *D02G 3/26* | (2006.01) |

(52) U.S. Cl.

CPC ..... *D03D 15/54* (2021.01); *A41D 13/008* (2013.01); *D02G 3/04* (2013.01); *D02G 3/045* (2013.01); *D02G 3/047* (2013.01); *D02G 3/441* (2013.01); *D02G 3/443* (2013.01); *D03D 1/0035* (2013.01); *D03D 15/47* (2021.01); *D03D 15/513* (2021.01); *D03D 15/533* (2021.01); *A41D 31/00* (2013.01); *A41D 31/08* (2019.02); *A41D 31/26* (2019.02); *D01F 1/06* (2013.01); *D01F 1/09* (2013.01); *D01F 6/52* (2013.01); *D01F 6/605* (2013.01); *D01F 8/10* (2013.01); *D02G 3/26* (2013.01); *D03D 1/0047* (2013.01); *D03D 15/00* (2013.01); *D03D 15/292* (2021.01); *D03D 15/41* (2021.01); *D10B 2321/08* (2013.01); *D10B 2331/021* (2013.01); *D10B 2401/00* (2013.01); *D10B 2401/04* (2013.01); *D10B 2401/14* (2013.01); *D10B 2401/16* (2013.01); *D10B 2501/00* (2013.01); *D10B 2501/04* (2013.01); *Y10S 428/92* (2013.01); *Y10S 428/922* (2013.01); *Y10T 428/2904* (2015.01); *Y10T 442/3073* (2015.04); *Y10T 442/3081* (2015.04); *Y10T 442/3984* (2015.04)

(58) Field of Classification Search
None
See application file for complete search history.

(56) References Cited

U.S. PATENT DOCUMENTS 3,803,453 A * 4/1974 Hull ..... D01F 1/09 361/220
3,848,028 A * 11/1974 Engelhard ..... C08K 5/372 524/368
4,045,949 A * 9/1977 Paton ..... D01D 5/28 57/244

(Continued)

FOREIGN PATENT DOCUMENTS

CN 101067254 A * 11/2007
CN 101368313 A * 2/2009

(Continued)

OTHER PUBLICATIONS

Machine Translation of JP-09111666-A, Apr. 1997 (Year: 1997).*
Machine Translation of JP-2002302837-A, Oct. 2002 (Year: 2002).*
Machine Translation of JP-2006176896-A, Jul. 2006 (Year: 2006).*
Machine Translation of CN-101368313-A, Feb. 2009 (Year: 2009).*
Machine Translation of JP-2006104588-A, Apr. 2006 (Year: 2006).*
Machine Translation of JP-2011202327-A, Oct. 2011 (Year: 2011).*
Machine Translation of JP-2014129616-A, Jul. 2014 (Year: 2014).*
Machine Translation of JP-2014210985-A, Nov. 2014 (Year: 2014).*

(Continued)

*Primary Examiner* — Jeffrey A Vonch
(74) *Attorney, Agent, or Firm* — Sughrue Mion, PLLC

(57) ABSTRACT

The invention addresses the problem of providing a cloth that is excellent not only in flame retardancy and antistatic properties but also in appearance quality and preferably also has protection performance against electric arcs, a method for producing the same, and a textile product. A means for resolution is a cloth including a meta-type wholly aromatic polyamide fiber and an electrically conductive fiber, wherein both the meta-type wholly aromatic polyamide fiber and the electrically conductive fiber are colored.

20 Claims, No Drawings

(56) References Cited

U.S. PATENT DOCUMENTS 4,107,129 A * 8/1978 Tanaka ..... D01F 1/09 524/505
4,145,473 A * 3/1979 Samuelson ..... D01F 8/04 264/172.12
4,207,376 A * 6/1980 Nagayasu ..... D01D 5/34 264/172.12
4,216,264 A * 8/1980 Naruse ..... D01F 1/09 428/367
4,255,487 A * 3/1981 Sanders ..... D02G 3/445 427/122
4,266,940 A * 5/1981 Blackburn ..... D06P 1/90 8/538
4,267,233 A * 5/1981 Tanaka ..... D06M 11/13 427/400
4,606,968 A * 8/1986 Thornton ..... A46D 1/00 428/372
4,612,150 A * 9/1986 De Howitt ..... D02G 3/441 264/103
5,207,803 A * 5/1993 Holsten ..... D06P 1/6495 8/586
5,213,892 A * 5/1993 Bruckner ..... D01D 5/34 428/372
5,391,432 A * 2/1995 Mitchnick ..... C01G 9/02 428/357
5,876,849 A * 3/1999 Green ..... D02G 3/441 428/359
5,935,882 A * 8/1999 Fujita ..... A41D 31/065 442/247
5,972,499 A * 10/1999 Rodriguez ..... D01D 5/06 428/368
6,057,032 A * 5/2000 Green ..... D03D 15/533 428/359
6,413,634 B1 * 7/2002 Tanaka ..... D01F 1/09 428/370
8,793,814 B1 * 8/2014 Dilanni ..... D03D 15/513 2/97
9,598,797 B1 * 3/2017 Zhu ..... D03D 1/0035
9,797,070 B1 * 10/2017 Newton ..... D01F 1/09
2002/0168908 A1 * 11/2002 Gibson ..... D02G 3/443 442/167
2003/0098068 A1 * 5/2003 Chi ..... A41D 31/00 137/420
2003/0203688 A1 * 10/2003 Campbell ..... D03D 15/0027 442/130
2004/0077241 A1 * 4/2004 Campbell ..... A41D 31/08 442/181
2005/0032449 A1 * 2/2005 Lovasic ..... D02G 3/047 442/209
2005/0204487 A1 * 9/2005 Zhu ..... D06P 3/8271 8/531
2006/0035553 A1 * 2/2006 Bader ..... D03D 15/513 442/239
2006/0068664 A1 * 3/2006 Gibson ..... D02G 3/443 442/197
2008/0057807 A1 * 3/2008 Tutterow ..... D04H 1/42 442/1
2008/0081529 A1 * 4/2008 Gehring, Jr. ..... D04B 21/12 442/308
2008/0095998 A1 * 4/2008 Thiriot ..... A62B 17/003 428/219
2008/0153374 A1 * 6/2008 Thiriot ..... D03D 15/513 442/302
2008/0295232 A1 * 12/2008 Truesdale, III ..... D06P 3/8209 2/458
2010/0009186 A1 * 1/2010 Zhu ..... D02G 3/047 428/395
2010/0146686 A1 * 6/2010 Winterhalter ..... D04H 1/4382 2/458
2010/0205723 A1 * 8/2010 Takahashi ..... A62B 17/003 2/458
2010/0279572 A1 * 11/2010 Fujita ..... D03D 15/00 442/195
2010/0299816 A1 * 12/2010 Zhu ..... D02G 3/443 2/458
2010/0299817 A1 * 12/2010 Zhu ..... D02G 3/443 2/458
2010/0324221 A1 * 12/2010 Yamato ..... D01F 6/18 525/196
2011/0138523 A1 * 6/2011 Layson, Jr. ..... B32B 5/26 2/458
2011/0172388 A1 * 7/2011 Yamauchi ..... D01F 6/605 528/348
2011/0183560 A1 * 7/2011 Hendel ..... D06P 1/0012 442/64
2011/0250810 A1 * 10/2011 Zhu ..... D02G 3/047 442/199
2011/0275267 A1 11/2011 Smith et al.
2012/0042442 A1 * 2/2012 Takahashi ..... A41D 31/08 2/458
2012/0077403 A1 * 3/2012 Gaillard ..... D01F 1/09 442/200
2012/0110721 A1 * 5/2012 Takahashi ..... B32B 27/12 2/458
2012/0183747 A1 * 7/2012 Bader ..... F41H 1/02 428/195.1
2012/0286177 A1 * 11/2012 Cliver ..... D06P 3/243 250/519.1
2013/0008554 A1 * 1/2013 Fisher ..... D03D 15/513 139/418
2013/0040523 A1 * 2/2013 Takahashi ..... D02G 3/28 442/190
2013/0042385 A1 * 2/2013 Hines ..... C08L 33/20 2/85
2013/0055490 A1 * 3/2013 Zhu ..... D03D 15/513 2/458
2013/0118635 A1 * 5/2013 Layson, Jr. ..... B32B 5/26 139/420 R
2013/0216810 A1 * 8/2013 Hines ..... A41D 1/06 428/219
2013/0254980 A1 * 10/2013 Underwood ..... A41D 1/06 2/458
2013/0267140 A1 * 10/2013 Gstettner ..... D02G 3/047 442/302
2014/0041107 A1 * 2/2014 Rose ..... A41D 31/08 2/455
2014/0187113 A1 * 7/2014 Hines, Jr. ..... D03D 15/513 442/199
2014/0196201 A1 * 7/2014 Deng ..... D06P 3/66 2/455
2015/0087775 A1 * 3/2015 Bader ..... D01F 6/805 524/602
2015/0191856 A1 * 7/2015 Hines ..... D02G 3/28 428/221
2015/0252499 A1 * 9/2015 Lipscomb ..... D02G 3/04 442/301
2016/0060809 A1 * 3/2016 Hines ..... D06P 1/0012 428/219
2016/0215446 A1 * 7/2016 Capt ..... D06P 5/2072
2017/0037543 A1 * 2/2017 Shimada ..... D01F 6/76
2017/0198423 A1 * 7/2017 Hines, Jr. ..... D02G 3/047
2017/0292210 A1 10/2017 Iwashita
2017/0295875 A1 * 10/2017 Ohzeki ..... D03D 1/00
2017/0306534 A1 * 10/2017 Parker ..... D02G 3/045
2018/0057964 A1 * 3/2018 Andersen ..... A41D 13/008
2018/0057965 A1 * 3/2018 Zhu ..... A41D 13/008
2018/0057969 A1 * 3/2018 Andersen ..... B29C 48/21
2018/0057978 A1 * 3/2018 Zhu ..... D01F 6/605
2018/0228225 A1 * 8/2018 Nakahashi ..... D01F 1/09
2018/0347079 A1 * 12/2018 Shimada ..... D02G 3/047

FOREIGN PATENT DOCUMENTS

CN 101377027 A * 3/2009
CN 101805935 A * 8/2010
CN 102191609 A * 9/2011
CN 202187142 U * 4/2012 ..... A41D 13/008
CN 102618984 A * 8/2012 ..... D06P 1/44
CN 103266499 A * 8/2013

(56) References Cited

FOREIGN PATENT DOCUMENTS

| | | | | | |
|---|---|---|---|---|---|
| CN | 103436974 | A | * | 12/2013 | D01F 1/09 |
| CN | 103789863 | A | * | 5/2014 | |
| CN | 105256444 | A | * | 1/2016 | D01F 1/09 |
| CN | 205556939 | U | * | 9/2016 | |
| DE | 29720988 | U1 | * | 4/1998 | A41D 13/008 |
| DE | 102008003966 | A1 | * | 4/2009 | D04B 21/14 |
| EP | 2481841 | A1 | | 8/2012 | |
| FR | 2792011 | A1 | * | 10/2000 | D06P 1/44 |
| GB | 1562461 | A | * | 3/1980 | D02G 3/441 |
| JP | 54032323 | U | * | 3/1979 | |
| JP | 54096113 | A | * | 7/1979 | |
| JP | 54138744 | A | * | 10/1979 | |
| JP | 55030436 | A | * | 3/1980 | |
| JP | 57039214 | A | * | 3/1982 | |
| JP | 05263318 | A | * | 10/1993 | |
| JP | 05311584 | A | * | 11/1993 | |
| JP | 05331781 | A | * | 12/1993 | |
| JP | 06240588 | A | * | 8/1994 | |
| JP | 08337925 | A | * | 12/1996 | |
| JP | 09078354 | A | * | 3/1997 | |
| JP | 09078376 | A | * | 3/1997 | |
| JP | 09078377 | A | * | 3/1997 | |
| JP | 09095870 | A | * | 4/1997 | |
| JP | 09111666 | A | * | 4/1997 | |
| JP | 11-250 | A | | 1/1999 | |
| JP | 2001164474 | A | * | 6/2001 | |
| JP | 2002302837 | A | * | 10/2002 | |
| JP | 2002363826 | A | * | 12/2002 | |
| JP | 2003064580 | A | * | 3/2003 | |
| JP | 2003171844 | A | * | 6/2003 | |
| JP | 2003-209776 | A | | 7/2003 | |
| JP | 2003239136 | A | * | 8/2003 | |
| JP | 2006-104588 | A | | 4/2006 | |
| JP | 2006104588 | A | * | 4/2006 | |
| JP | 2006176896 | A | * | 7/2006 | |
| JP | 2007009390 | A | * | 1/2007 | |
| JP | 2007092234 | A | * | 4/2007 | D01F 1/09 |
| JP | 2007119992 | A | * | 5/2007 | |
| JP | 2009-221632 | A | | 10/2009 | |
| JP | 2010-59589 | A | | 3/2010 | |
| JP | 2011202327 | A | * | 10/2011 | |
| JP | 2012082565 | A | * | 4/2012 | |
| JP | 2012207349 | A | * | 10/2012 | |
| JP | 2012219418 | A | * | 11/2012 | |
| JP | 2013-209776 | A | | 10/2013 | |
| JP | 2014-129616 | A | | 7/2014 | |
| JP | 2014129616 | A | * | 7/2014 | |
| JP | 2014-210985 | A | | 11/2014 | |
| JP | 2014210984 | A | * | 11/2014 | |
| JP | 2014210985 | A | * | 11/2014 | |
| JP | 2014214387 | A | * | 11/2014 | |
| JP | 2015-40361 | A | | 3/2015 | |
| KR | 101463384 | B1 | * | 11/2014 | |
| WO | 2009/014007 | A1 | | 1/2009 | |
| WO | 2010/006222 | A1 | | 1/2010 | |
| WO | WO-2010066095 | A1 | * | 6/2010 | D01F 8/04 |
| WO | 2015/159749 | A1 | | 10/2015 | |
| WO | 2016/035638 | A1 | | 3/2016 | |

OTHER PUBLICATIONS

Communication dated Aug. 13, 2019, from the European Patent Office in counterpart European Application No. 17866832.3.

"Industrial Fibers Materials Handbook", Textile Machinery Society of Japan, Jun. 25, 1979, p. 140 (4 pages total).

Notice of Reasons for Refusal dated Jan. 14, 2020 issued by the Japanese Patent Office in Application No. 2018-548954.

International Search Report for PCT/JP2017/038453 dated Jan. 30, 2018 (PCT/ISA/210).

Communication dated Mar. 31, 2020, from the Japanese Patent Office in Application No. 2018-548954.

Communication dated Apr. 26, 2020 from the State Intellectual Property Office of the P.R.C. in Application No. 201780067424.1.

Communication dated Jun. 10, 2020 from the European Patent Office in EP Application No. 17866832.3.

Communication dated Jun. 23, 2020 from the Japanese Patent Office in JP Application No. 2018-548954.

* cited by examiner

FABRIC, METHOD FOR MANUFACTURING SAME, AND FIBER PRODUCT

CROSS REFERENCE TO RELATED APPLICATIONS

This application is a National Stage of International Application No. PCT/JP2017/038453 filed Oct. 25, 2017, claiming priority based on Japanese Patent Application No. 2016-214220, filed Nov. 1, 2016 and Japanese Patent Application No. 2017-031094 filed Feb. 22, 2017.

TECHNICAL FIELD

The present invention relates to a cloth that is excellent not only in flame retardancy and antistatic properties but also in appearance quality and preferably also has protection performance against electric arcs, a method for producing the same, and a textile product.

BACKGROUND ART

Conventionally, in garments worn by fire fighters, pilots, race drivers, workers at power companies and chemical companies, and the like, assuming contact with flames or high temperatures, a flame-retardant cloth using a wholly aromatic polyamide fiber (aramid fiber) has been used.

In these garments, not only flame retardancy but also antistatic performance is required. Therefore, it has been proposed to mix an electrically conductive fiber, such as an electrically conductive aliphatic polyamide fiber (electrically conductive nylon fiber), into the cloth (e.g., PTL 1). When an electrically conductive fiber is mixed into a cloth, static electricity generated by the friction of the cloth is reduced, making it possible to prevent dust adhesion, harmful effects caused by discharge, ignition in an explosion-proof environment, and the like. In addition, it has been proposed to subject a flame-retardant cloth using a wholly aromatic polyamide fiber to a dyeing treatment (e.g., PTL 2 and PTL 3).

However, an electrically conductive aliphatic polyamide fiber is not colored with a cationic dye, which is used in the case of dyeing a flame-retardant cloth using a wholly aromatic polyamide fiber. Therefore, there has been a problem in that the appearance quality of the flame-retardant cloth decreases.

Meanwhile, those who work near electrical equipment and ambulance officers who deal with accidents near electrical equipment may be subconsciously exposed to electric arcs or flash fires, and there also is a demand for a cloth also having protection performance against electric arcs.

CITATION LIST

Patent Literature

PTL 1: WO 2016/035638
PTL 2: WO 2015/159749
PTL 3: JP-A-2013-209776

SUMMARY OF INVENTION

Technical Problem

The invention has been accomplished against the above background. An object thereof is to provide a cloth that is excellent not only in flame retardancy and antistatic properties but also in appearance quality and preferably also has protection performance against electric arcs, a method for producing the same, and a textile product.

Solution to Problem

The present inventors have conducted extensive research to achieve the above object. As a result, they have found that when a wholly aromatic polyamide fiber and an electrically conductive fiber, which can be colored with a same dye, are used, a cloth excellent not only in flame retardancy and antistatic properties but also in appearance quality can be obtained. As a result of further extensive research, they have accomplished the invention.

Thus, the invention provides "a cloth including a meta-type wholly aromatic polyamide fiber and an electrically conductive fiber, wherein both the meta-type wholly aromatic polyamide fiber and the electrically conductive fiber are colored."

At this time, it is preferable that the meta-type wholly aromatic polyamide fiber and the electrically conductive fiber contain a same dye. At this time, it is preferable that the dye is a cationic dye. In addition, it is preferable that the meta-type wholly aromatic polyamide fiber and the electrically conductive fiber are colored a same color. In addition, it is preferable that the electrically conductive fiber is an electrically conductive acrylic fiber. In addition, it is preferable that the electrically conductive acrylic fiber is a sheath-core conjugate fiber. At this time, it is preferable that the electrically conductive acrylic fiber is a sheath-core conjugate fiber including a core part containing electrically conductive microparticles and a sheath part not containing electrically conductive microparticles. In addition, it is preferable that the cloth contains the electrically conductive fiber in an amount of 1 to 30 mass % relative to the cloth mass. In addition, it is preferable that the meta-type wholly aromatic polyamide fiber and the electrically conductive fiber are contained in the form of a blended yarn. In addition, it is preferable that the cloth further contains at least one selected from the group consisting of para-type wholly aromatic polyamide fibers, polyphenylene sulfide fibers, polyimide fibers, polybenzimidazole fibers, polybenzoxazole fibers, polyamideimide fibers, polyetherimide fibers, Pyromex®, and carbon fibers. In addition, it is preferable that the cloth has a woven fabric structure. In addition, it is preferable that a spun yarn containing the meta-type wholly aromatic polyamide fiber and an antistatic fiber is placed in each of warp and weft yarns. In addition, it is preferable that the cloth has a weight per unit within a range of 3.0 to 9.0 $oz/yd^2$.

It is preferably that the cloth of the invention has a frictional charge quantity of 7.0 $\mu C/m^2$ or less as measured by JIS L1094-2014, C Method. In addition, it is preferable that the cloth of the invention has an afterflame time of 1.0 second or less in the flammability measurement according to JIS L1091-1992 A-4 Method (12-second flame application).

In addition, the invention provides a textile product using the cloth described above and selected from the group consisting of protective garments, work garments, fireproof garments, camouflage uniforms, happi coats, and aprons.

In addition, the invention provides a method for producing the cloth described above, including subjecting a cloth containing a meta-type wholly aromatic polyamide fiber and an electrically conductive fiber to dyeing processing.

Advantageous Effects of Invention

According to the invention, a cloth that is excellent not only in flame retardancy and antistatic properties but also in appearance quality and preferably also has protection performance against electric arcs, a method for producing the same, and a textile product are obtained.

DESCRIPTION OF EMBODIMENTS

Hereinafter, embodiments of the invention will be described in detail. First, the meta-type wholly aromatic polyamide fiber (meta-type aramid fiber) used in the invention is a fiber made of a polymer, wherein 85 mol % or more of the repeating unit is m-phenyleneisophthalamide. The meta-type wholly aromatic polyamide may also be a copolymer containing a third component in an amount within a range of less than 15 mol %.

Such a meta-type wholly aromatic polyamide can be produced by a conventionally known interfacial polymerization method. With respect to the polymerization degree of the polymer used, it is preferable that the intrinsic viscosity (I.V.) as measured with an N-methyl-2-pyrrolidone solution having a concentration of 0.5 g/100 ml is within a range of 1.3 to 1.9 dl/g.

The meta-type wholly aromatic polyamide may contain an alkylbenzenesulfonic acid onium salt. Preferred examples of alkylbenzenesulfonic acid onium salts include compounds such as a hexylbenzenesulfonic acid tetrabutylphosphonium salt, a hexylbenzenesulfonic acid tributylbenzylphosphonium salt, a dodecylbenzenesulfonic acid tetraphenylphosphonium salt, a dodecylbenzenesulfonic acid tributyltetradecylphosphonium salt, a dodecylbenzenesulfonic acid tetrabutylphosphonium salt, and a dodecylbenzenesulfonic acid tributylbenzylammonium salt. Among them, a dodecylbenzenesulfonic acid tetrabutylphosphonium salt and a dodecylbenzenesulfonic acid tributylbenzylammonium salt are particularly preferable because they are easy to obtain, have excellent thermal stability, and also have high solubility in N-methyl-2-pyrrolidone.

In order to obtain a sufficient dye affinity improving effect, it is preferable that the content of the alkylbenzenesulfonic acid onium salt is within a range of 2.5 mol % or more (more preferably 3.0 to 7.0 mol %) relative to poly-m-phenylene isophthalamide.

In addition, as a method for mixing poly-m-phenylene isophthalamide and an alkylbenzenesulfonic acid onium salt, a method in which poly-m-phenylene isophthalamide is mixed and dissolved in a solvent, and then an alkylbenzenesulfonic acid onium salt is dissolved in the solvent, is used, for example. The dope thus obtained is formed into a fiber by a conventionally known method.

As the polymer used for the meta-type wholly aromatic polyamide fiber, for the purpose of improving the dyeing affinity and discoloration/fading resistance, for example, it is also possible that into an aromatic polyamide backbone having a repeating structural unit represented by the following formula (1), an aromatic diamine component or aromatic dicarboxylic acid halide component, which is different from a main unit of the repeating structure, is copolymerized as a third component to represent 1 to 10 mol % based on the total amount of repeating structural units in the aromatic polyamide.

$$—(NH—Ar1-NH—CO—Ar1-CO) \quad \text{formula (1)}$$

Here, Ar1 is a divalent aromatic group having a linking group in a position other than the meta position or the axially parallel direction.

In addition, the following third components are also copolymerizable. Specific examples of aromatic diamines represented by formulae (2) and (3) include p-phenylenediamine, chlorophenylenediamine, methylphenylenediamine, acetylphenylenediamine, aminoanisidine, benzidine, bis(aminophenyl)ether, bis(aminophenyl)sulfone, diaminobenzanilide, and diaminoazobenzene. Specific examples of aromatic dicarboxylic acid dichlorides represented by formulae (4) and (5) include terephthalic acid chloride, 1,4-naphthalenedicarboxylic acid chloride, 2,6-naphthalenedicarboxylic acid chloride, 4,4'-biphenyldicarboxylic acid chloride, 5-chloroisophthalic acid chloride, 5-methoxyisophthalic acid chloride, and bis(chlorocarbonylphenyl)ether.

$$H_2N—Ar2-NH_2 \quad \text{formula (2)}$$

$$H_2N—Ar2-Y—Ar2-NH_2 \quad \text{formula (3)}$$

$$XOC—Ar3-COX \quad \text{formula (4)}$$

$$XOC—Ar3-Y—Ar3-COX \quad \text{formula (5)}$$

Here, Ar2 is a divalent aromatic group different from Ar2, Ar3 is a divalent aromatic group different from Ar1, Y is at least one atom or functional group selected from the group consisting of an oxygen atom, a sulfur atom, and an alkylene group, and X is a halogen atom.

In addition, from the standpoint that the dye exhaustion is good, and the color can be easily adjusted as intended even with a reduced amount of dye or under weak dyeing conditions, it is preferable that the crystallinity of the meta-type wholly aromatic polyamide fiber is 5 to 35%. Further, from the standpoint that the dye is less likely to be unevenly distributed on the surface, the discoloration/fading resistance is also high, and the practically necessary dimensional stability can also be ensured, the crystallinity is more preferably 15 to 25%.

In addition, from the standpoint that the excellent flame retardancy of the meta-type wholly aromatic polyamide fiber is not impaired, it is preferable that the residual solvent content of the meta-type wholly aromatic polyamide fiber is 0.1 mass % or less (more preferably 0.001 to 0.1 mass %).

The meta-type wholly aromatic polyamide fiber can be produced by the following method. In particular, by the method described below, the crystallinity and the residual solvent content can be made within the above ranges.

The polymerization method for the meta-type wholly aromatic polyamide polymer is not particularly limited. For example, the solution polymerization method and the interfacial polymerization method described in JP-B-35-14399, U.S. Pat. No. 3,360,595, JP-B-47-10863, and the like may be used.

The spinning solution is not particularly limited. It is possible to use an amide-based solvent solution containing an aromatic copolyamide polymer obtained by the solution polymerization or interfacial polymerization described above, for example, or it is also possible that the polymer is isolated from the polymerization solution, dissolved in an amide-based solvent, and used.

Examples of amide-based solvents used herein include N,N-dimethylformamide, N,N-dimethylacetamide, N-methyl-2-pyrrolidone, and dimethyl sulfoxide. N,N-dimethylacetamide is particularly preferable.

When the copolymerized aromatic polyamide polymer solution obtained as above further contains an alkali metal salt or alkaline earth metal salt, the solution is further stabilized and becomes usable at higher concentrations and lower temperatures; therefore, this is preferable. The alkali metal salt or alkaline earth metal salt is preferably 1 mass % or less (more preferably 0.1 mass % or less) based on the total mass of the polymer solution.

In a spinning/coagulation step, the spinning solution obtained above (meta-type wholly aromatic polyamide polymer solution) is extruded into a coagulation liquid and coagulated.

The spinning apparatus is not particularly limited, and a conventionally known wet-spinning apparatus can be used. In addition, as long as wet spinning can be stably performed, there are no particular limitations on the number of spinning holes of the spinneret, their arrangement, the hole shape, and the like. For example, it is possible to use a multi-hole spinneret for staple fibers, in which the number of holes is 1,000 to 30,000 and the spinning hole diameter is 0.05 to 0.2 mm, or the like.

In addition, it is preferable that the temperature of the spinning solution (meta-type wholly aromatic polyamide polymer solution) upon extrusion from the spinneret is within a range of 20 to 90° C.

As a coagulation bath used to obtain the fiber, it is preferable to use an aqueous solution containing substantially no inorganic salt and having an amide-based solvent, preferably NMP, concentration of 45 to 60 mass % at a bath liquid temperature within a range of 10 to 50° C. When the amide-based solvent (preferably NMP) concentration is less than 45 mass %, this may result in a thick-skin structure, whereby the washing efficiency in a washing step decreases, making it difficult to reduce the residual solvent content of the fiber. Meanwhile, in the case where the amide-based solvent (preferably NMP) concentration is more than 60 mass %, uniform coagulation inside fibers may not be achieved, making it difficult, also in this case, to reduce the residual solvent content of the fiber. Incidentally, it is preferable that the time of fiber immersion in the coagulation bath is within a range of 0.1 to 30 seconds.

Subsequently, the fiber is drawn to a draw ratio of 3 to 4 in a plastic drawing bath containing an aqueous solution having an amide-based solvent, preferably NMP, concentration of 45 to 60 mass % at a bath liquid temperature within a range of 10 to 50° C. After drawing, the fiber is thoroughly washed with an aqueous solution at 10 to 30° C. having an NMP concentration of 20 to 40 mass % and then through a hot water bath at 50 to 70° C. The fiber after washing is subjected to a dry heat treatment at a temperature of 270 to 290° C.

By such a production method, a meta-type wholly aromatic polyamide fiber that satisfies the above crystallinity and residual solvent content ranges can be obtained.

In the meta-type wholly aromatic polyamide fiber, the fiber may be in the form of long fibers (multifilament) or short fibers. In particular, for blend-spinning with other fibers, short fibers having a fiber length of 25 to 200 mm (more preferably 30 to 150 mm) are preferable. In addition, it is preferable that the single-fiber fineness is within a range of 1 to 5 dtex.

In the cloth of the invention, it is preferable that the mass ratio of the meta-type wholly aromatic polyamide fiber is within a range of 70 to 99 mass % (more preferably 75 to 95 mass % relative to the cloth mass. When the mass ratio of the meta-type wholly aromatic polyamide fiber is lower than this range, the flame retardancy of the cloth may decrease. Conversely, when the mass ratio of the meta-type wholly aromatic polyamide fiber is higher than this range, because the mass ratio of the electrically conductive fiber decreases, the antistatic properties may decrease.

Meanwhile, as the electrically conductive fiber, an electrically conductive acrylic fiber is preferable. When the cloth contains a meta-type wholly aromatic polyamide fiber and an electrically conductive acrylic fiber, by dyeing the cloth with a cationic dye, both the meta-type wholly aromatic polyamide fiber and the electrically conductive acrylic fiber are dyed a deep color, and also the entire cloth is uniformly dyed. At this time, it is preferable that the meta-type wholly aromatic polyamide fiber and the electrically conductive fiber are colored a same color. Here, it is preferable that the hue difference between the meta-type wholly aromatic polyamide fiber and the electrically conductive fiber is ΔE 3 or less.

As the electrically conductive acrylic fiber, a fiber obtained by kneading electrically conductive carbon into an acrylic fiber, a sheath-core conjugate fiber including a core part containing electrically conductive microparticles and a sheath part not containing electrically conductive microparticles, or the like is preferable. In particular, a sheath-core conjugate fiber (or eccentric sheath-core conjugate fiber), in which the sheath part is made of acrylic not containing electrically conductive microparticles, while the core part is made of an electrically conductive carbon-containing polymer, or the like is preferable. When such an electrically conductive acrylic fiber is contained in the cloth, static electricity generated by the friction of the cloth can be reduced. As a result, problems such as dust adhesion, harmful effects caused by discharge, and ignition in an explosion-proof environment can be reduced.

As the electrically conductive acrylic fiber, for example, the fiber described in JP-A-2009-221632 is preferable. That is, the fiber is a sheath-core electrically conductive acrylic fiber including a core part containing electrically conductive microparticles and a sheath part not containing electrically conductive microparticles, wherein the core-sheath ratio is 15/85 to 50/50, the electrically conductive microparticle content of the core part is 20 to 60 mass %, and the single-fiber resistivity is $10^1$ to $10^6$ Ω·cm.

In the electrically conductive fiber, the fiber may be in the form of long fibers (multifilament) or short fibers. In particular, for blend-spinning with other fibers, short fibers having a fiber length of 25 to 200 mm (more preferably 30 to 150 mm) are preferable. In addition, it is preferable that the single-fiber fineness is within a range of 1 to 5 dtex.

In the cloth of the invention, it is preferable that the mass ratio of the electrically conductive fiber is within a range of 1 to 30 mass % (more preferably 1 to 20 mass %) relative to the cloth mass. When the weight ratio of the electrically conductive fiber is lower than this range, the antistatic properties of the cloth may decrease. Conversely, when the mass ratio of the electrically conductive fiber is higher than this range, because the mass ratio of the meta-type wholly aromatic polyamide fiber decreases, the flame retardancy may decrease.

The cloth of the invention may be composed only of the meta-type wholly aromatic polyamide fiber and the electrically conductive fiber, but may further contain at least one selected from the group consisting of para-type wholly aromatic polyamide fibers, polyphenylene sulfide fibers, polyimide fibers, polybenzimidazole fibers, polybenzoxazole fibers, polyamideimide fibers, polyetherimide fibers, Pyromex®, and carbon fibers.

For example, when a para-type wholly aromatic polyamide fiber is contained in the cloth, the strength of the cloth (tensile strength, etc.) improves; therefore, this is preferable. At this time, it is preferable that the mass ratio of the para-type wholly aromatic polyamide fiber is within a range of 1 to 10 mass % relative to the cloth mass.

The cloth of the invention may further contain a polyester fiber. A polyester fiber may be contained in the cloth. At this time, it is preferable that the mass ratio of the polyester fiber is within a range of 1 to 10 mass % relative to the cloth mass.

Here, in order to obtain a cloth excellent not only in flame retardancy and antistatic properties but also in appearance quality, it is preferable that these fibers are blend-spun and contained in the form of a blended yarn in the cloth. At this time, it is preferable that the fiber length of each fiber is 25 to 200 mm (more preferably 30 to 150 mm). Incidentally, the fiber lengths of fibers may be the same as or different from each other.

In the invention, in order to obtain a high-quality appearance, it is important that both the meta-type wholly aromatic polyamide fiber and the electrically conductive fiber are colored. In particular, it is preferable that the meta-type wholly aromatic polyamide fiber and the electrically conductive fiber are colored a same color (ΔE is 3 or less).

Here, it is preferable that the meta-type wholly aromatic polyamide fiber and the electrically conductive fiber contain a same dye. In particular, it is preferable that the dye is a cationic dye.

A cationic dye refers to a water-soluble dye soluble in water and having a group that exhibits basicity, and has been widely used in the dyeing of, for example, acrylic fibers, natural fibers, or cationic-dyeable polyester fibers. Examples of cationic dyes include diacrylic methane dyes, triacrylic methane dyes, quinoneimine (azine, oxazine, thiazine) dyes, xanthene dyes, methine dyes (polymethine, azamethine), heterocyclic azo dyes (triazole azo, triazole azo, benzothiazole azo), and anthraquinone dyes. In addition, in recent years, dispersed cationic dyes obtained by blocking basic groups are also known, and both can be used. Among them, azo dyes are preferable. Preferred examples of azo dyes include C.I. Basic Blue 54, C.I. Basic Blue 3, C.I. Basic Red 29, and C.I. Basic Yellow 67.

In the invention, the method for producing the cloth is not particularly limited, and any known methods may be used. For example, at least a meta-type wholly aromatic polyamide fiber and an electrically conductive fiber are blended into a spun yarn.

At this time, in terms of resistance to yarn breakage, strength, and the like, the fineness of the spun yarn (count) is preferably a cotton count (Ecc) of 20 to 80. The number of single yarns is preferably 60 or more. The raw cotton single-fiber fineness is preferably 3.0 dtex or less (more preferably 0.001 to 3.0 dtex). The twist coefficient (first twist coefficient) of the spun yarn is preferably within a range of 3.6 to 4.2 (more preferably 3.8 to 4.0). With an increase in the twist coefficient, the fluff is settled, and the pilling resistance of the cloth improves; on the other hand, the spun yarn becomes rigid, whereby the elongation may decrease, resulting in a decrease in the tear strength of the cloth, or the cloth may be hardened. Incidentally, the twist coefficient is expressed by the following equation.

$$\text{Twist coefficient} = \text{the number of twists (twists/2.54 cm)} / \text{the cotton count of the spun yarn (Ecc)}^{1/2}$$

The spinning method for the spun yarn may be innovative spinning, such as ring spinning, MTS, MJS, or MVS, or an ordinary spinning method, such as ring spinning. The twist direction may be Z-direction or S-direction.

Next, the spun yarn is twist-set as necessary (vacuum steam setting), and then, as necessary, two or more of the spun yarns (preferably two to four yarns, particularly preferably two yarns) are aligned, combined, and plied. As twisting machines used for plying, twisting machines such as an up-twister, a covering machine, an Italian twisting machine, and a double twister can be mentioned.

At this time, the twisting direction in plying (second twisting) is the twist-adding direction. For example, in the case where the twist direction of the spun yarn is Z-twisted, twisting is performed in the same direction, that is, in the Z-direction. In addition, the number of twists is preferably 2,000/m or more, more preferably 2,100 to 3,000/m, and particularly preferably 2,300 to 2,800/m. In the case where the number of twists is less than 2,000/m, after twist setting and untwisting, the spun yarn may not be in coiled form.

Next, the plied yarn is twist-set (the same high-pressure vacuum steam setting as used for twist-setting a conventional aramid double ply yarn). In the case where firm twist setting has to be imparted, the number of times of twist setting may be increased, or the twist setting temperature or setting time may be changed. For example, the setting temperature may be 115 to 125° C., the setting time may be 20 to 40 minutes, and the number of times may be 1 to 3. A higher setting temperature or a longer setting time results in better setting properties and thus is more preferable. The setting properties can be further enhanced by increasing the number of times of twist setting, prolonging the treatment time, or raising the temperature. Considering the production control (the safety of work control, quality control, etc.) and the production/processing cost, it is preferable to prolong the treatment time. In addition, a higher degree of vacuum results in improved quality and thus is preferable.

Next, the twist-set plied yarn is untwisted (twisted in the direction opposite to the twist direction in plying), and heat-set as necessary. At this time, the number of twists in untwisting is preferably within a range of 70 to 90% of the number of twists in plying. When untwisting is performed with the number of twists being within this range, a spun yarn in coiled form having stretchability is obtained. In such a spun yarn in coiled form, in order to obtain excellent stretchability, it is preferable that the number of twists is within a range of 200 to 860/m.

In addition, the raw cotton used for the spun yarn may be dyed (yarn-dyed) raw cotton or spun-dyed raw cotton, or it is also possible to use raw cotton that has been subjected to a functionalization treatment (sweat absorption, quick dry, soil resistance, flame retardancy, UV absorption, etc.).

In the cloth of the invention, the structure of the cloth is not particularly limited, and may be a woven fabric, a knitted fabric, or a nonwoven fabric. However, in terms of flame retardancy, fireresistance, cloth strength, and the like, a woven fabric is preferable. At this time, as the woven fabric structure, a plain structure, a twill structure, a satin structure, a double fabric, and the like are preferable.

As the density of the woven fabric, in order to obtain excellent protection performance against electric arcs, it is preferable that the warp density is 50 yarns/2.54 cm or more and the weft density is 50 yarns/2.54 cm or more (more preferably the warp density is 60 yarns/2.54 cm or more and the weft density is 60 yarns/2.54 cm or more, and particularly preferably the warp density is 60 to 80 yarns/2.54 cm and the weft density is 60 to 80 yarns/2.54 cm or more).

In addition, when a spun yarn containing a meta-type aromatic polyamide fiber and an antistatic fiber is placed in each of the warp and weft yarns of the woven fabric, the protection performance against electric arcs improves; therefore, this is preferable.

The cloth of the invention can be knitted or woven in the usual manner using the spun yarn described above. At this time, it is preferable that the spun yarn is woven as a single yarn or a double ply yarn using a rapier loom or the like into a twill weave, a plain weave, or a like structure. A knitted fabric and a nonwoven fabric are also possible.

Knitting or weaving is preferably followed by post-processing. Specific examples of post-processing steps include scouring, drying, relaxing, singeing, dyeing, and functionalization treatments.

Here, as the dyeing processing, it is preferable that the dyeing processing is performed in a dyeing bath containing the cationic dye described above. At this time, a method in which dyeing is performed at 115 to 135° C., followed by a reduction treatment and drying, can be preferably employed, for example, but the method is not limited thereto.

In addition, in the dyeing processing, it is preferable that a carrier agent is used, and the dyeing treatment is performed in one bath containing the cationic dye and the carrier agent. In addition, when the cloth is treated with a special surfactant before the cationic dyeing, deep dyeing in open-width dyeing can be achieved.

It is preferable that the carrier agent is, for example, at least one selected from DL-β-ethylphenethyl alcohol, 2-ethoxybenzyl alcohol, 3-chlorobenzyl alcohol, 2,5-dimethylbenzyl alcohol, 2-nitrobenzyl alcohol, p-isopropylbenzyl alcohol, 2-methylphenethyl alcohol, 3-methylphenethyl alcohol, 4-methylphenethyl alcohol, 2-methoxybenzyl alcohol, 3-iodobenzyl alcohol, cinnamic alcohol, p-anisyl alcohol, and benzhydrol. As specific products, benzyl alcohol, DOWANOL PPH manufactured by Dow Chemical Company, and CINDYE DNK manufactured by BOZZETTO are preferable. In addition, in terms of further improving the dye affinity, it is preferable to use benzyl alcohol, particularly 2,5-dimethylbenzyl alcohol or 2-nitrobenzyl alcohol.

The amount of carrier agent is preferably 1 to 10 parts by weight (more preferably 1 to 5 parts by weight) per 100 parts by weight of the meta-type wholly aromatic polyamide fiber.

The scouring or relaxing treatment may be an open-width treatment or a jet scouring/relaxing treatment. Specifically, it is a method in which the cloth is treated with an open-width non-tension machine in continuous scouring or continuous drying. Such a method uses, for example, a Sofcer scouring machine, a tenter and drying machine, a shrink surfer, a short loop, a Luciole dryer, or the like. In some cases, the scouring or relaxing step may be omitted.

In addition, for improving other properties, shaving and/or singeing may also be performed. Further, it is also possible to additionally apply other various processes for imparting the functions of a sweat absorbent, a water repellent, a heat storage agent, UV shielding, an antistatic agent, an antibacterial agent, a deodorant, an insect repellent, a mosquito repellent, a phosphorescent agent, a retroreflective agent, and the like. The woven or knitted fabric used may be a spun-dyed product, a yarn-dyed product, or a piece-dyed product.

Preferred examples of sweat absorbents include polyethylene glycol diacrylate, a polyethylene glycol diacrylate derivative, a polyethylene terephthalate-polyethylene glycol copolymer, and a water-soluble polyurethane.

As methods for imparting a sweat absorbent to the cloth, a method that performs a padding treatment, a method in which the cloth is treated at the time of dyeing processing in the same bath as the dyeing liquid, and the like can be mentioned.

In the cloth thus obtained, it is preferable that the thickness of the cloth is 0.30 mm or more (more preferably 0.35 to 0.50 mm). When the thickness of the cloth is less than 0.30 mm, the protection performance against electric arcs may decrease. Conversely, when the thickness of the cloth is more than 0.50 mm, the lightweight properties and wearing comfort may decrease.

In addition, it is preferable that the weight per unit of the cloth is within a range of 3.0 to 9.0 oz/yd$^2$ (more preferably 5.0 to 9.0 oz/yd$^2$). When the weight per unit of the cloth is lower than this range, the protection performance against electric arcs may decrease. Conversely, when the weight per unit of the cloth is higher than this range, the lightweight properties and wearing comfort may decrease.

The cloth of the invention has the above configuration, and thus is excellent not only in flame retardancy and antistatic properties but also in appearance quality and further has protection performance against electric arcs.

In the cloth of the invention, in the case where an electrically conductive acrylic fiber including a core part containing electrically conductive microparticles and a sheath part not containing electrically conductive microparticles is contained, the electrically conductive microparticles contained in the core part absorb the irradiation energy of electric arc flash and suppress the energy that permeates the cloth. Accordingly, such a cloth has excellent protection performance for the human body. The sheath part is made of an acrylic polymer not containing electrically conductive microparticles, and thus can be dyed with the same cationic dye as for the meta-type wholly aromatic polyamide fiber.

Here, as antistatic properties, it is preferable that the frictional charge quantity measured by JIS L1094-2014, C Method, is 7.0 μC/m$^2$ or less (more preferably 0.1 to 4.0 μC/m$^2$). In addition, as flame retardancy, it is preferable that the afterflame time in the flammability measurement according to JIS L1091-1992, A-4 Method (12-second flame application), is 1.0 second or less. In addition, it is preferable that the ATPV value in Arc Resistance Test ASTM F1959-1999 is 8.0 cal/cm$^2$ or more (preferably 8.0 to 12.0 cal/cm$^2$). In addition, it is preferable that the limiting oxygen index (LOI) is 26 or more.

In addition, the invention provides a textile product using the cloth described above and selected from the group consisting of protective garments, work garments, fireproof garments, camouflage uniforms, happi coats, and aprons.

The textile product uses the cloth described above, and thus is excellent not only in flame retardancy and antistatic properties but also in appearance quality and further has protection performance against electric arcs.

EXAMPLES

Hereinafter, the invention will be described in detail with reference to examples, but the invention is not limited thereto. Incidentally, in the examples, the properties were measured by the following methods.

(1) Flame Retardancy of Cloth

The afterflame time was measured by the flammability measurement according to JIS L1091-1992, A-4 Method (12-second flame application).

(2) Residual Solvent Content

About 8.0 g of a raw fiber was collected, dried at 105° C. for 120 minutes, and then allowed to cool in a desiccator, and the fiber mass (M1) was measured. Subsequently, the fiber was subjected to reflux extraction in methanol for 1.5 hours using a Soxhlet extractor to extract the amide-based solvent contained in the fiber. The fiber after extraction was taken out, vacuum-dried at 150° C. for 60 minutes, and then allowed to cool in a desiccator, and the fiber mass (M2) was measured. Using the obtained M1 and M2, the content of residual solvent in the fiber (amide-based solvent mass) was calculated using the following equation.

$$\text{Residual solvent content (\%)}=[(M1-M2)/M1]\times 100$$

(3) Crystallinity

An about 1 mm-diameter bundle of raw fibers was mounted on a fiber sample table and subjected to measurement of diffraction profile using an X-ray diffraction apparatus (RINT TTRIII manufactured by Rigaku Corporation). The measurement conditions were as follows: Cu—Kα radiation source (50 kV, 300 mA), scanning angle range: 10 to 35°, continuous measurement, measurement width: 0.1°, scanning at 1°/min. From the measured diffraction profile, air scattering and incoherent scattering were corrected by linear approximation to give the total scattering profile. Next, the amorphous scattering profile was subtracted from the total scattering profile to give the crystal scattering profile. The crystallinity was determined from the integrated intensity of the crystal scattering profile (crystal scattering intensity) and the integrated intensity of the total scattering profile (total scattering intensity) using the following equation.

$$\text{Crystallinity (\%)}=[\text{crystal scattering intensity}/\text{total scattering intensity}]\times 100$$

(4) Dye Affinity

Color measurement was performed using a Macbeth spectrophotometer (Color-Eye 3100) to determine ΔE.

(5) Antistatic Properties

The frictional charge quantity was measured by JIS L1094-2014, C Method. 7.0 $\mu C/m^2$ or less was rated as acceptable.

(6) Weight per Unit

Measurement was performed in accordance with JIS L1096.

(7) ATPV Value

The ATPV value was measured in accordance with Arc Resistance Test ASTM F1959-1999. 8.0 $cal/cm^2$ or more is rated as acceptable (Level 2 satisfied).

[Production of Meta-Type Wholly Aromatic Polyamide Fiber]

A meta-type wholly aromatic polyamide fiber was prepared by the following method.

20.0 parts by mass of a polymetaphenylene isophthalamide powder having an intrinsic viscosity (I.V.) of 1.9 produced by an interfacial polymerization method based on the method described in JP-B-47-10863 was suspended in 80.0 parts by mass of N-methyl-2-pyrrolidone (NMP) cooled to −10° C., thereby forming a slurry. Subsequently, the suspension was heated to 60° C. for dissolution to give a transparent polymer solution. A powder of 2-[2H-benzotriazol-2-yl]-4-6-bis(1-methyl-1-phenylethyl)ph enol (solubility in water: 0.01 mg/L) in an amount of 3.0 mass % relative to the polymer was mixed with and dissolved in the polymer solution, and the mixture was defoamed under reduced pressure to give a spinning solution (spinning dope).

[Spinning/Coagulation Step]

The above spinning dope was discharged and spun from a spinneret having 500 0.07-mm-diameter holes into a coagulation bath at a bath temperature of 30° C. The composition of the coagulation liquid was water/NMP=45/55 (parts by mass), and the dope was discharged and spun into the coagulation bath at a yarn speed of 7 m/min.

[Drawing Step in Plastic Drawing Bath]

Subsequently, drawing was performed to a draw ratio of 3.7 in a plastic drawing bath at a temperature of 40° C. having a composition of water/NMP=45/55.

[Washing Step]

After drawing, washing was performed in a bath at 20° C. having water/NMP=70/30 (immersion length: 1.8 m) and then in a water bath at 20° C. (immersion length: 3.6 m), followed by thorough washing through a hot water bath at 60° C. (immersion length: 5.4 m).

[Dry Heat Treatment Step]

The fiber after washing was subjected to a dry heat treatment using a hot roller having a surface temperature of 280° C. to give a meta-type wholly aromatic polyamide fiber.

[Properties of Raw Fiber]

The obtained meta-type wholly aromatic polyamide fiber (meta-aramid fiber) had the following properties: fineness: 1.7 dtex, residual solvent content: 0.08 mass %, crystallinity: 19%. The obtained raw fiber was crimped and cut into short fibers of 51 mm in length (raw cotton).

Example 1

Using the above meta-type wholly aromatic polyamide fiber, a para-type wholly aromatic polyamide fiber having a single-fiber fineness of 1.7 dtex and a fiber length of 50 mm (manufactured by Teijin Aramid, trade name "Twaron"), and an electrically conductive acrylic fiber having a single-fiber fineness of 3.3 dtex and a fiber length of 38 mm (manufactured by Mitsubishi Chemical Corporation, trade name "COREBRID", eccentric sheath-core electrically conductive acrylic fiber; sheath part: acrylic/core part: electrically conductive carbon-containing polymer), a spun yarn of 1/68 yarn count was formed such that the meta-type wholly aromatic polyamide fiber: 93 mass %, the para-type wholly aromatic polyamide fiber: 5 mass %, and the electrically conductive acrylic fiber: 2 mass %, and a double ply yarn plied yarn was obtained.

Next, the yarn was placed in each of warp and weft yarns, and a plain-structure woven fabric having a warp density of 57 yarns/2.54 cm and a weft density of 50 yarns/2.54 cm was woven.

Using a jet dyeing machine (high-temperature circular dyeing machine manufactured by Hisaka Works, Ltd.), the obtained undyed woven fabric (gray fabric) was treated in a dye bath containing a cationic dye (manufactured by Nippon Kayaku Co., Ltd., Kayacryl Red GL-ED, 15% owf) and a carrier agent (manufactured by Dow Chemical Company, DOWANOL PPH, 40 g/L). The temperature was raised from ambient, and the fabric was dyed at 130° C. for 60 minutes.

The obtained dyed cloth had excellent appearance quality with a deep color and no color non-uniformity. In addition, the meta-type wholly aromatic polyamide fiber and the electrically conductive fiber were colored a same color, and the hue difference ΔE between the two was 3 or less. In addition, the frictional charge quantity was as excellent as 3.3 $\mu C/m^2$. In addition, the afterflame time was 0 second, indicating excellent flame retardancy.

Example 2

A dyed cloth was obtained in the same manner as in Example 1, except that a spun yarn of 1/68 yarn count was formed such that the meta-type wholly aromatic polyamide fiber: 80 mass %, the para-type wholly aromatic polyamide fiber: 5 mass %, and the electrically conductive acrylic fiber: 15 mass %.

The obtained dyed cloth had excellent appearance quality with a deep color and no color non-uniformity. In addition, the meta-type wholly aromatic polyamide fiber and the electrically conductive fiber were colored a same color, and the hue difference ΔE between the two was 3 or less. In addition, the frictional charge quantity was as excellent as 1.4 μC/m$^2$. In addition, the afterflame time was 0 second, indicating excellent flame retardancy.

Comparative Example 1

A dyed cloth was obtained in the same manner as in Example 1, except that an electrically conductive aliphatic polyamide fiber having a single-fiber fineness of 4.5 dtex and a fiber length of 51 mm (eccentric sheath-core electrically conductive nylon fiber; sheath part: Nylon 6/core part: white metal compound) was used as an electrically conductive fiber.

In the obtained dyed cloth, although the frictional charge quantity was as excellent as 2.4 μC/m$^2$, with respect to the appearance quality, the electrically conductive aliphatic polyamide fiber was not colored, resulting in color non-uniformity. In addition, the afterflame time was 0 second, indicating excellent flame retardancy.

Example 3

Spun yarns (first-twisted in the Z-direction, the number of twists: 800 to 950/m, cotton count: 40/1) each made of a polymetaphenylene isophthalamide fiber (Teijinconex® neo (trade name) manufactured by Teijin Limited, single-fiber fineness: 1.7 dtex, fiber length: 51 mm), an electrically conductive acrylic fiber (COREBRID (trade name) manufactured by Mitsubishi Chemical Corporation), and a para-type wholly aromatic polyamide fiber (Twaron® TW1072 manufactured by Teijin Aramid, single-fiber fineness: 1.7 dtex, fiber length: 51 mm) uniformly blended in a blending ratio of 85/10/5 (mass %) in the above order were combined, twisted using a double twister (900 twists/m in the S-direction), and then, as twist setting, steam-set at 120° C.×30 min, thereby giving a 2-ply yarn.

In addition, a 3-ply yarn formed by adding an electrically conductive yarn (B-TCF U300HX of Teijin Limited, total fineness: 31 dtex/5 fil) to the above combined spun yarns was obtained in the same manner.

Subsequently, using the 2-ply yarn and the 3-ply yarn, the 3-ply yarn was placed at a pitch of 2.02 cm wide (the 3-ply yarn corresponds to about 2 mass % of the warp yarn) and creeled for warping. The obtained warp beam was subjected to sizing, leasing, and threading as warp yarn preparation. In addition, the 2-ply yarn was used as a weft yarn.

Next, a 2/2 twill-structure woven fabric was woven at a warp density of 69 yarns/2.54 cm and a weft density of 62 yarns/2.54 cm.

The obtained gray fabric was unrolled and sewn in the usual manner, and, using an open-width non-tension scouring machine (Sofcer), subjected to desizing, scouring, cylinder drying, singeing, and dyeing, followed by finish setting (180° C.×45 to 90 sec), thereby giving a finished textile having a weight per unit of 5.4 oz/yd$^2$.

Subsequently, the cloth was subjected to dyeing processing under the following conditions, and the polymetaphenylene isophthalamide fiber and the electrically conductive acrylic fiber contained in the cloth were colored.

(Dyeing Processing Conditions)

Cationic dye: manufactured by Nippon Kayaku, trade name: Kayacryl Red GL-ED, 6.0% owf, 40 g/L swelling agent, 3 cc/L acetic acid, 1 cc/L dispersant, 25 g/L sodium nitrate Bath ratio: 1:20

Temperature×Time: 130° C.×60 minutes

The ATPV value was 8.7 cal/cm$^2$, that is, acceptable (Level 2 satisfied).

Example 4

The same procedure as in Example 3 was performed, except that the para-type wholly aromatic polyamide fiber (Twaron® TW1072 manufactured by Teijin Aramid, single-fiber fineness: 1.7 dtex, fiber length: 51 mm) was replaced with a copolyparaphenylene-3,4' oxydiphenylene terephthalamide (PPODPA) fiber (Technora® manufactured by Teijin Limited). The ATPV value was 8.9 cal/cm$^2$, that is, acceptable (Level 2 satisfied).

Example 5

The same treatment as in Example 3 was performed, except that the polymetaphenylene isophthalamide fiber (Teijinconex® neo (trade name) manufactured by Teijin Limited, single-fiber fineness: 1.7 dtex, fiber length: 51 mm) was replaced with a polymetaphenylene isophthalamide fiber (Teijinconex® FRNB3 manufactured by Teijin Limited, single-fiber fineness: 1.7 dtex, fiber length: 51 mm). The ATPV value was 8.9 cal/cm$^2$, that is, acceptable (Level 2 satisfied).

Example 6

The same procedure as in Example 3 was performed, except that a 1/1 plain woven fabric was woven at the following weaving design density: a warp density of 62 yarns/2.54 cm and a weft density of 52 yarns/2.54 cm. A finished textile having a weight per unit of 4.5 oz/yd$^2$ was thus obtained and evaluated in the same manner. The ATPV value was 6.7 cal/cm$^2$, that is, unacceptable.

Comparative Example 2

The same treatment and evaluation as in Example 3 were performed, except that the fiber materials and the blending amounts were changed such that the electrically conductive acrylic fiber was 0 wt %. The ATPV value was 7.8 cal/cm$^2$, that is, unacceptable.

INDUSTRIAL APPLICABILITY

According to the invention, a cloth that is excellent not only in flame retardancy and antistatic properties but also in appearance quality and preferably also has protection performance against electric arcs, a method for producing the same, and a textile product are provided. The industrial value thereof is extremely high.

The invention claimed is:

1. A flame-retardant and antistatic cloth, comprising:

a meta-type wholly aromatic polyamide fiber, an electrically conductive acrylic fiber, and an additional fiber being at least one selected from the group consisting of para-type wholly aromatic polyamide fibers, polyphenylene sulfide fibers, polyimide fibers, polybenzimidazole fibers, polybenzoxazole fibers, polyamideimide fibers, polyetherimide fibers, and carbon fibers;

wherein the meta-type wholly polyamide fiber and the electrically conductive fiber are contained in the form of a blend-spun yarn, wherein the meta-type wholly aromatic polyamide fiber is within the range from 80 to less than 99 mass % relative to the cloth mass;

wherein the electrically conductive acrylic fiber is a sheath-core conjugate fiber including a core part containing electrically conductive carbon microparticles and a sheath part not containing any electrically conductive microparticles, wherein the electrically conductive acrylic fiber is within the range of greater than 1 to less than 20 mass % relative to the cloth mass;

wherein both the meta-type wholly aromatic polyamide fiber and the electrically conductive acrylic fiber are colored using the same cationic dye, such that a hue difference between the meta-type wholly aromatic polyamide fiber and the electrically conductive acrylic fiber is ΔE 3 or less, wherein the cloth comprises an ATPV value in Arc Resistance Test ASTM F1959-1999 of 8.0 cal/cm2 or more, a frictional charge quantity of 7.0 μC/m2 as measured by a JS L1094-2014, C method, and an afterflame time of 1.0 second or less in a flammability measurement according to JIS L1091-1992,A-4 Method (12-second flame application).

2. The cloth according to claim 1, wherein the range of the electrically conductive fiber is within 5 to 15 mass % relative to the cloth mass.

3. The cloth according to claim 2, wherein the range of the electrically conductive fiber is within 10 to 15 mass % relative to the cloth mass.

4. The cloth according to claim 1, wherein the additional fiber comprises para-type wholly aromatic polyamide fibers, the para-type wholly aromatic polyamide fibers within a range of 1 to 10 mass % relative to the cloth mass.

5. The cloth according to claim 1, wherein the meta-type wholly aromatic polyamide fiber is made of a polymer wherein 85 mol % or more of the repeating unit is m-phenylene isophthalamide.

6. The cloth according to claim 5, wherein the meta-type wholly aromatic polyamide fiber contains an alkylbenzenesulfonic acid onium salt, within a range of 2.5 mol % or more relative to a total amount of m-phenylene isophthalamide units.

7. The cloth according to claim 6, wherein the polymer is a copolymer further comprising an aromatic diamine component or aromatic dicarboxylic acid halide component, different from a main unit, in a range of less than 15 mol % relative to a total amount of repeating structural units in the copolymer.

8. The cloth according to claim 1, wherein the residual solvent content of the meta-type wholly aromatic polyamide fiber is 0.1 mass % or less.

9. The cloth according to claim 1, wherein the meta-type wholly aromatic polyamide fiber has a crystallinity of 5 to 35%.

10. The cloth according to claim 9, wherein the crystallinity is 15 to 25%.

11. The cloth according to claim 10, wherein the crystallinity is 15 to 19%.

12. The cloth according to claim 1, wherein an electrically conductive carbon microparticle content of the core part is 20 to 60 mass % and the electrically conductive acrylic fiber comprises a single-fiber resistivity is $10^1$ to $10^6$ Ω·cm.

13. The cloth according to claim 1, wherein the cationic dye is azo dye.

14. The cloth according to claim 10, wherein the azo dye is selected from the group consisting of C.I. Basic Blue 54, C.I. Basic Blue 3, C.I. Basic Red 29, and C.I. Basic Yellow 67.

15. The cloth according to claim 1, wherein a fiber length of each fiber of the blend-spun yarn is 25 to 200 mm.

16. The cloth according to claim 1, wherein the blend-spun yarn comprises a fineness being a cotton count (Ecc) of 20 to 80 and comprises a twist coefficient, wherein the twist coefficient is expressed by the following equation:

$$\text{twist coefficient} = \text{number of twists per 2.54 cm}/\text{Ecc}^{1/2} \text{ within a range of 3.6 to 4.2.}$$

17. The cloth according to claim 1, wherein the cloth has a weight per unit area within a range of 3.0 to 9.0 yd/oz$^2$ and a thickness of at least 0.30 mm.

18. The cloth according to claim 1, wherein the cloth comprises a woven structure comprising warp yarns and weft yarns, wherein each of the warp yarns and the weft yarns comprise the blend-spun yarn.

19. The cloth according to claim 18, wherein the woven structure comprises a warp density of 60 to 80 yarns/2.54 cm and a weft density of 60 to 80 yarns/2.54 cm.

20. A wearable textile product comprising the cloth according to claim 1, selected from the group consisting of protective garments, workgarments, fireproof garments, camouflage uniforms, happi coats, and aprons.

* * * * *